US005800314A

United States Patent [19]

Sakakibara et al.

[11] Patent Number: 5,800,314

[45] Date of Patent: Sep. 1, 1998

[54] USER-MOTION-RESPONSE TYPE EXERCISE EQUIPMENT

[75] Inventors: Yoshihiro Sakakibara, Ryugasaki; Yukio Yamada, Hitachinaka; Kitami Suzuki, Abiko, all of Japan

[73] Assignee: Hitachi Techno Engineering Co., Ltd., Tokyo, Japan

[21] Appl. No.: 692,523

[22] Filed: Aug. 5, 1996

[30] Foreign Application Priority Data

Sep. 26, 1995 [JP] Japan ..... 7-247817

[51] Int. Cl.[6] ..... A63B 23/00

[52] U.S. Cl. ..... 482/54; 482/1; 482/3; 482/4; 482/7; 482/901

[58] Field of Search ..... 482/1, 3, 4–9, 482/54, 900–902

[56] References Cited

U.S. PATENT DOCUMENTS 4,708,337 11/1987 Shyu ..... 482/54
5,314,391 5/1994 Potash et al. ..... 482/7
5,368,532 11/1994 Farent ..... 482/5

*Primary Examiner*—Richard J. Apley
*Assistant Examiner*—Glenn E. Richman
*Attorney, Agent, or Firm*—Antonelli, Terry, Stout & Kraus, LLP

[57] ABSTRACT

A user-motion-response type exercise equipment capable of changing the moving speed of the moving belt surface so as to follow the running speed of the runner from the start to end of running. The equipment includes an endless belt mechanism having a moving surface for the user (runner) to walk or run on, a driving mechanism for driving the endless belt mechanism to move the moving belt surface at a speed in accordance with a control signal supplied externally, a position detector for detecting the user's position on the moving belt surface, and a controller for performing a control action combining a proportional control action and an integral control action in parallel in accordance with the user's position on the moving belt surface detected by the position detector as the controlled variable, and generating a control signal supplied externally to the driving mechanism and sending the control signal to the driving mechanism.

14 Claims, 10 Drawing Sheets

USER-MOTION-RESPONSE TYPE EXERCISE EQUIPMENT

BACKGROUND OF THE INVENTION

1. Field of the Invention

The present invention relates to a user-motion-response type exercise equipment in which the user walks or runs on an endless belt surface rotated by a driving means, and more particularly to a user-motion-response type exercise equipment suitable for jogging of runners, running exercise of top athletes who participate in marathon races, exercise for competitive walking, and a wide variety of walking exercises for loosing weight, rehabilitation, etc.

2. Prior Art

A user-motion-response type exercise equipment which varies the running speed by detecting the position of the user has been disclosed in JP-B-2-47231 and JP-A-63-309280. The user-motion-response type exercise equipment revealed in JP-B-247231 performs on/off switching of acceleration according to the runner's position on the moving belt. To be more specific, if the runner's position on the moving belt exceeds a reference line, a certain form of acceleration control is performed to increase the speed of the moving belt. The user-motion-response type exercise equipment in JP-A-63-309280 gives a changing rate to the speed of the moving belt on the basis of the distance between the runner and the distance measuring device.

Therefore, this means that in the above-mentioned prior-art exercise equipment, the moving belt is controlled only by integral control (integral control action).

When the runner actually runs on a road or on a track in an athletic field, he speeds up and slows the running speed, and also changes acceleration. So, when the runner runs on the moving belt of the exercise equipment, even if he changes his running speed, it is desired that the runner's position should be placed in a fixed range. In the above-mentioned prior-art exercise equipment, however, even if the runner changes his running speed, the moving speed of the moving belt of the exercise equipment does not change quickly. Therefore, while waiting for the moving belt to be accelerated, the runner has to slow acceleration and has a different sensation from that he feels when he actually runs on a road or track.

In order for the user to be able to accelerate or decelerate repeatedly, it was necessary to provide a moving belt surface of longer than 3 m in the endless rotating belt.

In the user-motion-response type exercise equipment disclosed in JP-A-63-309280, to obtain a quick response from the exercise equipment, if the gain of the control loop is made excessively high, sometimes hunting occurs in which the speed of the endless belt increases and decreases rapidly.

In that type of above-mentioned prior-art exercise equipment in which the moving speed of the moving belt does not change quickly when the user changes his speed, if the user walking for rehabilitation feels incongruous with the speed of the moving belt and stops, there is a danger that the user drops off the moving belt surface because the exercise equipment does not slow down in time.

SUMMARY OF THE INVENTION

An object of the present invention is to provide a user-motion-response type exercise equipment which can change the moving speed of the moving belt from the start of running or walking till the end so as to follow the running speed of the user.

Another object of the present invention is to provide a user-motion-response type exercise equipment which stops the moving belt immediately when the user walking for rehabilitation stops, thus preventing the user from dropping off the moving belt surface.

Yet another object of the present invention is to provide a user-motion-response type exercise equipment which is compatible with different kinds of usage of a variety of users, such as a runner to enter himself for a running race, such as a marathon, a walker for rehabilitation, etc.

According to an aspect of the present invention, there is provided a user-motion-response type exercise equipment comprising an endless belt mechanism having a moving surface or a moving belt surface for a user to walk or run on, driving means for driving said endless belt mechanism such that the moving belt surface moves at a speed based on a control signal supplied from outside, position detecting means for detecting the user's position on the moving surface, and control means for performing a control action combining a proportional control action and an integral control action in parallel according to the user's position detected by the position detecting means as a controlled variable, and on the basis of a result of the control action, sending the control signal to the driving means.

As the control means performs a control action combining a proportional control action and an integral control action in parallel, it is possible to move the moving belt surface so as to follow the running speed of the user. In addition, since an integral control action is performed, the offset of the user's position on the moving belt surface from the reference position can be reduced to nil.

According to another aspect of the present invention, there is provided a user-motion-response type exercise equipment in which when performing a control action, if the control means receives a result requesting that the moving belt surface should be moved in a first direction, the control means issues a control signal to move the moving belt surface as requested by the control result, or if the control means receives a result requesting that the moving belt surface should be moved in a second direction opposite to the first direction, the control means issues a control signal to stop the moving belt.

The moving belt surface moves only in the direction opposite to the direction in which the user runs. Therefore, while the user steps on the moving belt surface from the rear side and goes toward the reference position, the moving belt surface does not move in the running direction of the user. When the user has crossed the reference position, the moving belt surface starts moving in the direction opposite to the running direction of the user.

According to yet another aspect of the present invention, there is provided a user-motion-response type exercise equipment including display means for receiving a signal corresponding to the control signal from the control means and displaying control information on the basis of the received signal.

The user can be aware of the controlled condition of the exercise equipment.

DESCRIPTION OF THE PREFERRED EMBODIMENTS

Figure 1:
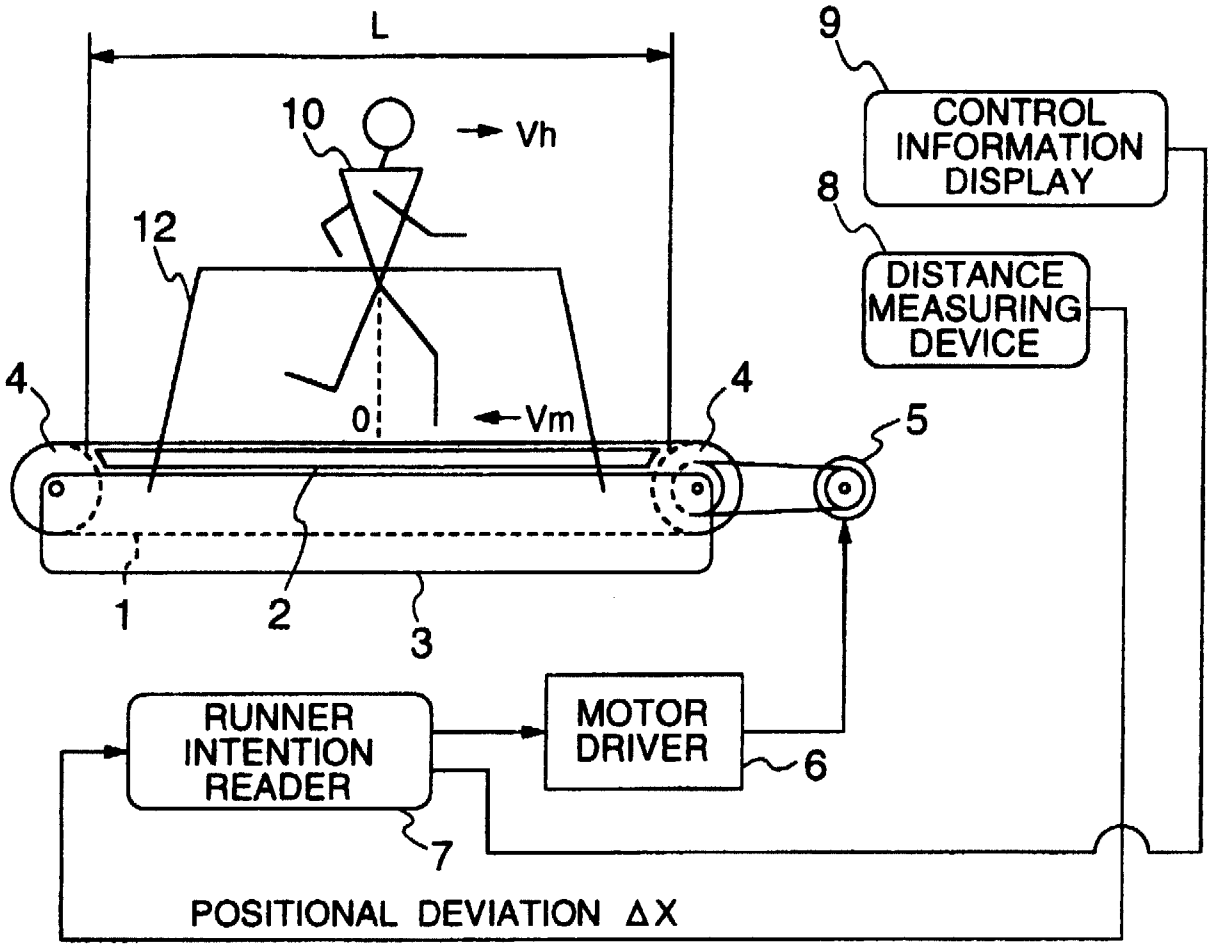
FIG. 1 is a construction diagram of the user-motion-response type exercise equipment according to an embodiment of the present invention.

FIG. 1 is a schematic partial front view of the user-motion-response type exercise equipment chiefly for users who run on this exercise equipment and also includes a block diagram of the control system. Two rollers 4 are attached to a frame 3, and an endless belt 1 is applied between the two rollers 4. A runner 10 runs on the top surface (moving belt surface) of the endless belt 1. The moving belt surface moves in a direction opposite to the direction of the runner. In FIG. 1, the runner is running in the right direction.

On both sides of the runner 10, there are arranged handrails 12 attached to the frame 3. Beneath the moving surface or the moving belt surface of the endless belt 1, there is arranged a support plate 2 supporting the weight of the runner 10 for the whole footpath length L. A rotating force is applied to one roller 4 from a motor 5 through a pulley. The motor is driven by a motor driver 6.

On a frame 3, not shown, located in front of the runner, there is arranged a distance measuring device 8, including an ultrasonic or optical sensor, or the like. The distance measuring device 8 measures the runner's positional deviation Δx from the reference position 0, and sends positional deviation information corresponding to a positional deviation Δx to a runner intention reader 7. The runner intention reader 7, on the basis of information about the runner's positional deviation, decides a suitable moving speed of the moving belt surface of the endless belt, and sends a motor control signal to the motor driver 6. A control information display 9 is formed by a CRT, liquid crystal panel, plasma display panel, or the like. On the basis of acceleration and deceleration information, the control information display 9 shows the acceleration and deceleration condition to the runner in a visually recognizable form.

Description will be made of the operation of the user-motion-response type exercise equipment in FIG. 1.

The runner steps on the moving belt surface in the area behind the reference position 0 (on the left side in FIG. 1), and starts to walk or run facing the front where the distance measuring device is located. The distance measuring device 8 measures the distance from the reference position 0 to the runner 10, namely, a positional deviation Δx. A positional deviation Δx in the condition that the runner 10 is beyond the reference position 0 is expressed as positive and a positional deviation Δx in the condition that the runner is behind the reference position 0 is expressed negative.

The distance measuring device 8 subtracts the installation distance between the user 10 and the distance measuring device 8 from the installation distance between the reference position 0 and the distance measuring device 8, and outputs a resulting positional deviation Δx.

If the runner moves beyond the reference position 0, the positional deviation Δx is positive. When detecting that the positional deviation Δx has become positive, the runner intention reader 7 instructs the motor driver 6 to start to rotate the motor. The motor driver 6 sends a drive signal to the motor 5, and the motor 5 starts to rotate, by which the endless belt 1 starts to rotate.

The operation of the motor driver 6 and the runner intention reader 7 will be described with reference to FIG. 2.

Figure 2:
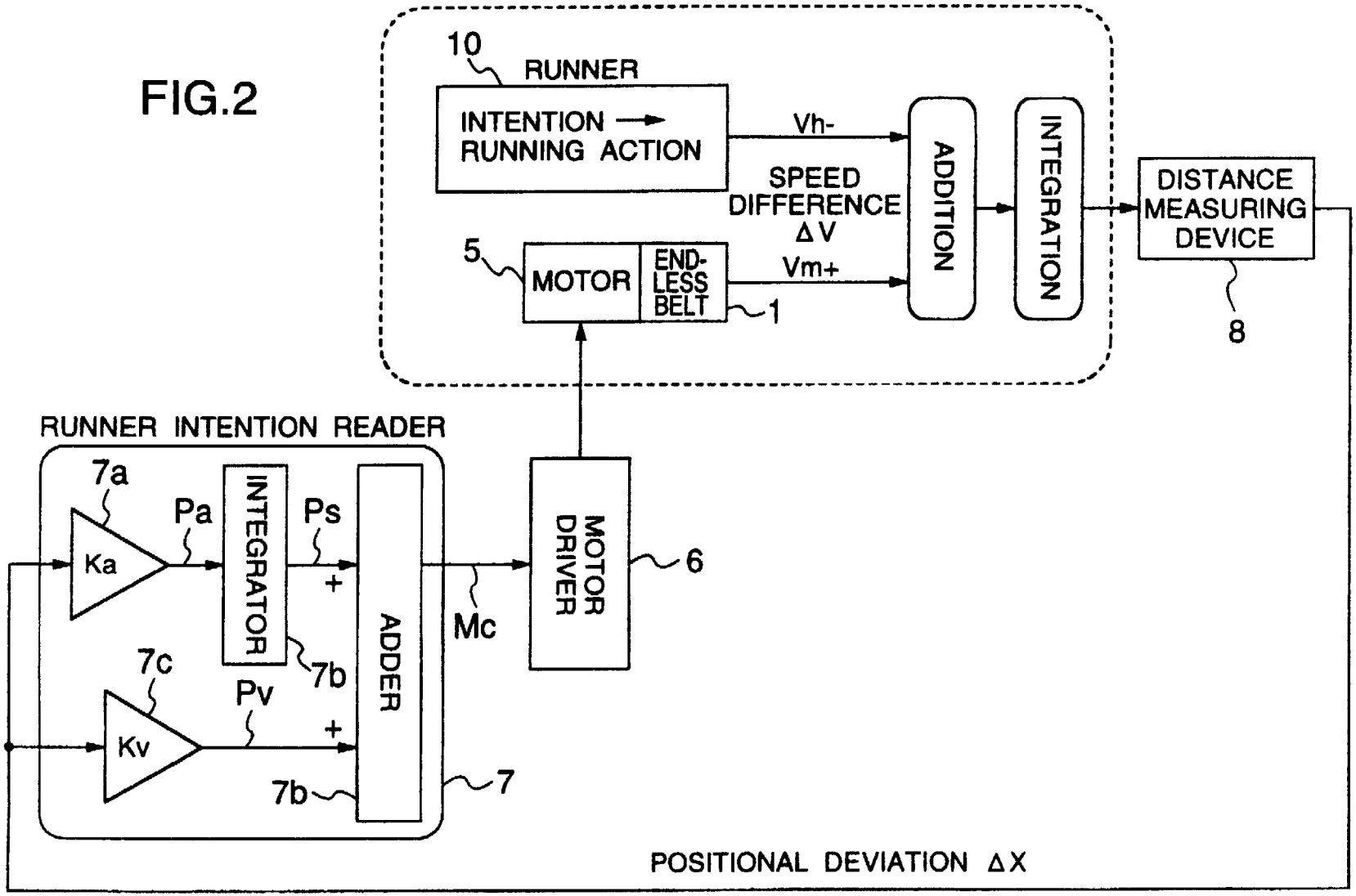
FIG. 2 is a block diagram showing detail of the control system of the user-motion-response type exercise equipment in FIG. 1.

As shown in FIG. 2, the running action occurs on the basis of the runner's intention to increase or decrease speed. The runner makes a muscular motion according to his intention, and as a result, he reaches a running speed of Vh at a certain time. The moving surface of the endless belt moves at a belt speed or a moving speed or a belt moving speed of Vm in a direction opposite to the running direction of the runner 10. The runner 10 on the moving surface moves at a speed, which is a difference ΔV between the running speed Vh and the belt speed Vm with respect to the reference position 0. By integrating this speed difference ΔV, the position of the runner with respect to the reference position 0 can be obtained.

The measured distance by the distance measuring device 8 fixed to the frame 3 is the distance between the runner 10 moving at a speed ΔV and the distance measuring device 8. The positional deviation Δx can be obtained by finding a difference between the distance from the reference position 0 to the distance measuring device 8 and the above-mentioned measured distance to the runner 10.

Figure 3:
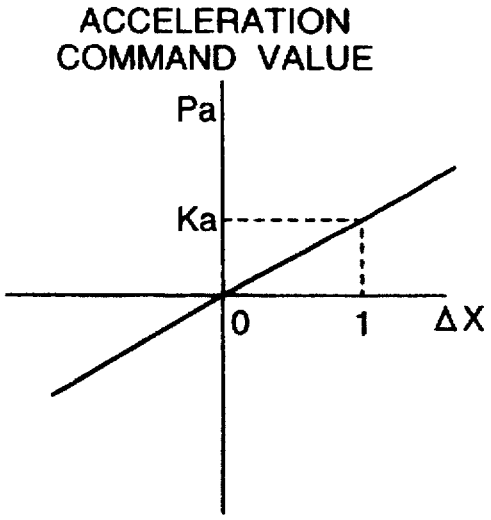
FIG. 3 is a diagram showing an example of the characteristics of the acceleration command processor of the runner intention reader in the user-motion-response type exercise equipment in FIG. 1.
Figure 4:
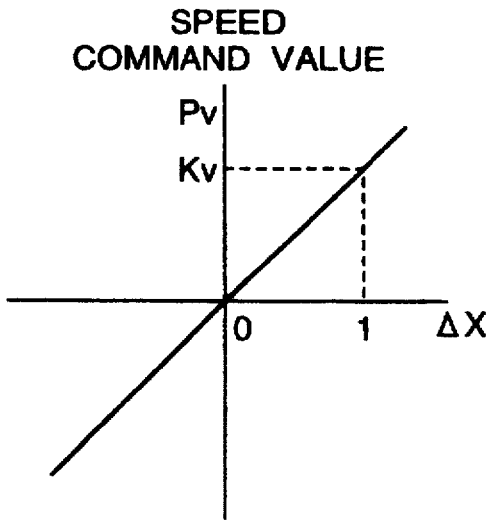
FIG. 4 is a diagram showing an example of the characteristics of the speed command processor of the runner intention reader in the user-motion-response type exercise equipment in FIG. 1.

The runner intention reader 7 includes amplifiers 7*a* and 7*c*, an integrator 7*b*, and an adder 7*d*. The amplifier 7*a* generates an acceleration command value Pa as shown in FIG. 3 by adding gain Ka to the positional deviation signal Δx supplied from the distance measuring device 8. The integrator 7*b* generates a speed command value Ps by integrating the acceleration command value Pa with respect to time. The amplifier 7*c* generates a speed command value Pv as shown in FIG. 4 by adding gain Kv to the positional deviation signal Δx supplied from the distance measuring device 8. The adder 7*d* generates a motor control signal Mc by adding the speed command value Ps and the speed command value Pv together. The runner intention reader 7 performs a control action combining a proportional control action and an integral control action in parallel according to the positional deviation signal Δx as the controlled variable and Δx=0 as the target value.

Description will be made of the result of simulation when control with only integral control action without the amplifier 7c was performed.

Figure 5A:
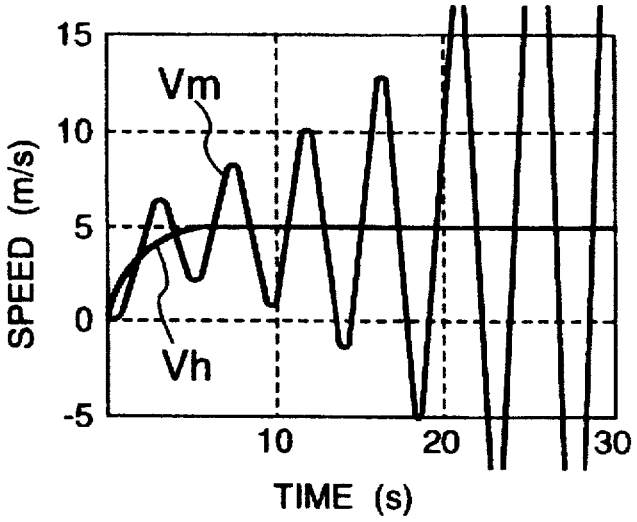
FIGS. 5A and 5B are diagrams showing the characteristics of the user-motion-response type exercise equipment by simulation in a case where the runner intention reader of the user-motion-response type exercise equipment was controlled only by integral control action.

FIG. 5A shows the change with time of the running speed Vh of the runner 10 and the moving speed Vm of the moving belt surface if the running speed Vh of the runner 10 is as expressed by Eq. (1):

$$Vh=(1-\exp(-0.5t)\times Vmax \quad (1)$$

where t represents the elapsed time from the start of running and Vmax represents the final speed reached and Vmax is supposed to be 5 m/s and gain Ka is supposed to be 0.4.

For about two seconds after the start of running, the moving speed Vm of the moving belt surface rises later than does the running speed Vh of the runner 10. Even after the moving speed Vm catches up with the running speed Vh, the acceleration of the belt moving speed Vm does not decrease, thus resulting in overshoot. After the running speed has reached a substantially constant level, the belt moving speed Vm repeats this fluctuation, and accordingly the belt moving speed assumes an oscillating condition. Even if the gain Ka is increased, only result obtained is the increase of the frequency of the oscillation, making it impossible to perform stable control.

Figure 5B:
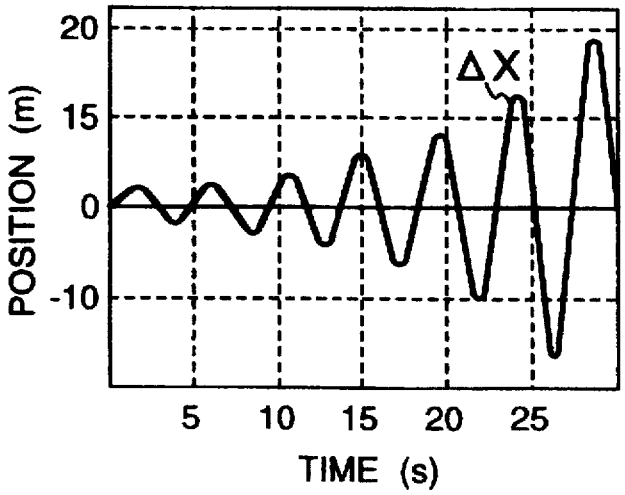

FIG. 5B shows the change with time of the runner's positional deviation Δx from the reference position 0. Even after the running speed Vh of the runner has reached a substantially constant level, the positional deviation Δx oscillates, too, because the moving speed Vm of the moving belt surface oscillates. In short, even if the runner is running at a constant speed, the runners position with regard to the reference position 0 constantly changes.

Description will now be made of the result of simulation when an amplifier 7c is added to the runner intention reader 7 as shown in FIG. 2 and control is performed which combines a proportional control action and an integral control action in parallel.

Figure 6A:
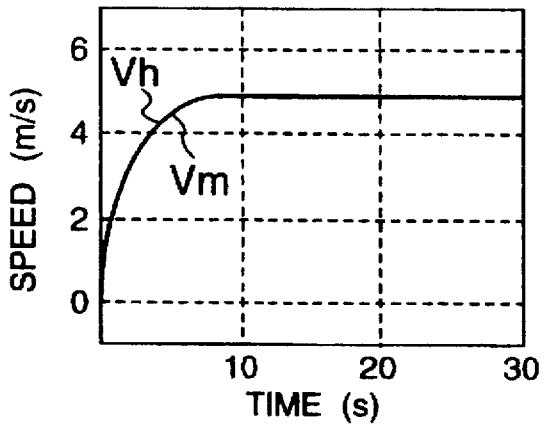
FIGS. 6A, 6B and 6C are diagrams showing the characteristics of the user-motion-response type exercise equipment by simulation of the user-motion-response type exercise equipment in FIG. 1.

FIG. 6A shows the change with time of the running speed Vh of the runner 10 and the moving speed Vm of the moving belt surface. The running speed Vh is supposed to be expressed by Eq.(1) like the case in FIG. 5. The gain Ka was set to be 2 and the gain Kv was set to be 10. As shown in FIG. 6A, the running speed Vh of the runner substantially agrees with the moving speed Vm of the moving belt surface.

Figure 6B:
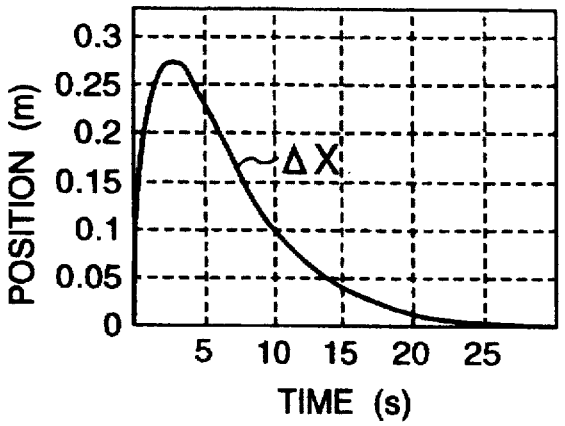

FIG. 6B shows the change with time of the runner's positional deviation Δx from the reference position 0, wherein 2.5 seconds after the start of running, the runner's positional deviation Δx takes a maximum value of 28 cm, and then monotonously decreases and converges to 0.

Figure 6C:
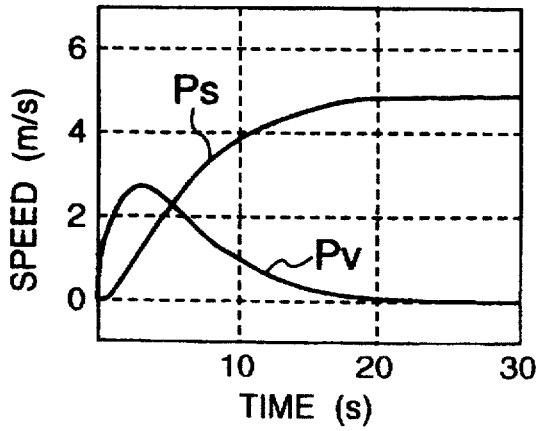

FIG. 6C shows the change with time of the command values Ps and Pv. When the runner starts to run, the command value Pv increases and the command value Ps, a little delayed, increases, too. In other words, at the beginning of running, the proportional control system including the amplifier 7c of the runner intention reader 7 in FIG. 2 works chiefly. As time elapses, the command value Pv gradually decreases and the command value Ps becomes greater. In a steady state that the runner is running at a substantially constant speed, the integral control system including the amplifier 7a and the integrator 7b works chiefly. In the steady state, the positional deviation Δx is 0, and the command value Ps, which is obtained by integrating Pa in the integrator 7b and has been output up to this point in time, is output so that the steady speed is maintained. In this way, control following the running speed Vh is performed.

Figure 7A:
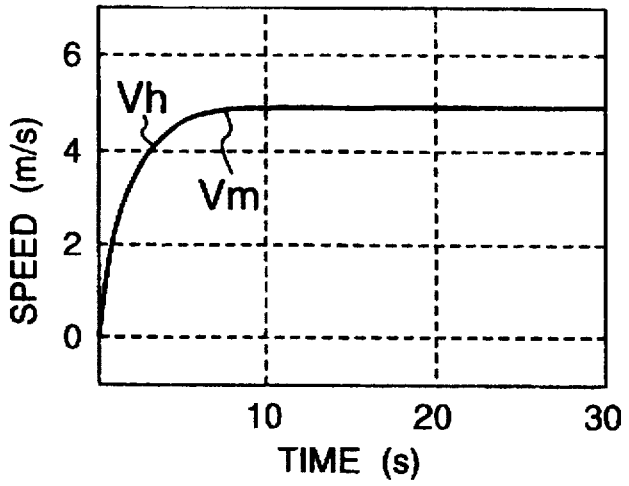
FIGS. 7A and 7B are diagrams showing the characteristics of the user-motion-response type exercise equipment by simulation when the runner intention reader of the user-motion-response type exercise equipment in FIG. 1 was controlled only by proportional control action.
Figure 7B:
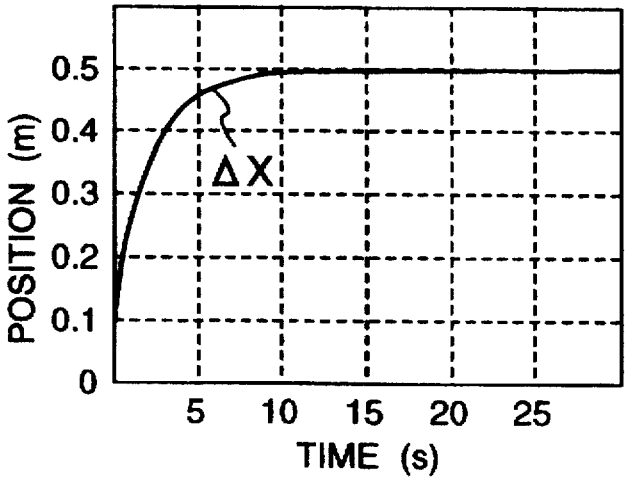

FIGS. 7A and 7B show results of simulation when only the proportional control action was performed by excluding the integral control system, including the amplifier 7a and the integrator 7b of the runner intention reader 7.

FIG. 7A shows the change with time of the running speed Vh of the runner 10 and the moving speed Vm of the moving belt surface. FIG. 7B shows the change with time of the runner's positional deviation Δx from the reference position 0. As shown in FIG. 7A, the moving speed Vm of the moving belt surface increases following the running speed Vh of the runner.

However, as the integral control system was excluded, when the positional deviation Δx becomes 0, the runner intention reader 7 outputs a motor control signal of 0, and as a result, a constant speed cannot be maintained. For this reason, as shown in FIG. 7B, in a steady state, the runner continues running no less than 50 cm ahead of the reference position 0. In order to freely increase and decrease his speed during control only with a speed command value Pv, a relatively long footpath is required. Since the hustling runner changes his position greatly, if a camera is used to monitor the runner from his side, it is necessary to move the camera to follow the runner.

By providing the runner intention reader 7 with a proportional control system and an integral control system, the runner's positional deviation Δx in the steady state can be reduced to 0 as shown in FIG. 6B. Therefore, the runner can increase and decrease his speed more naturally even on a short footpath.

When starting to run, the runner steps on the moving belt surface, and advances to come into the measuring range of the distance measuring device 8. Until he reaches the reference position 0 in FIG. 1, his positional deviation Δx is negative, so that the command value Pv is negative. At this time, because integration results are not stored in the integrator 7b, the output signal Mc of the adder 7d is negative. To be more specific, the motor 5 rotates in the reverse direction to the rotating direction during the ordinary running condition. If a limiter is inserted so that the output signal Mc is 0 when the result of addition of the speed command values Ps and Pv is negative, the motor can be prevented from rotating in the reverse direction and the motor 5 can be kept at a standstill until the runner reaches the reference position 0.

When the runner starts to run and crossed the reference position 0, the runner intention reader 7 issues a signal to rotate the motor 5, and the endless belt 1 starts to move. This action corresponds to the runner stepping in the track from the field of an athletic field and crossing the starting line. When the runner slows down, having run a certain distance, he moves to the rear side of the moving belt surface. This movement of the runner is detected, the endless belt 1 is decelerated and eventually comes to the zero speed at the reference position 0. The runner's action of moving to the rear side and stepping down from the footpath corresponds to his moving from the track to the field in an athletic field.

Also in this case, by installing a limiter to prevent the motor 5 from rotating in reverse direction, the endless belt 1 can be kept at a standstill even when the runner moves to the rear side. As described above, by adding a function to prevent a reverse rotation with respect to the reference position 0, the runner may feel virtual reality as if he is practicing on the track.

Referring back to FIG. 1, the control information display 9 displays the amount of acceleration of the moving belt surface decided by the runner intention reader 7 and the runner's positional deviation Δx measured by the distance measuring device 8 in a bar graph, for example, on a CRT, crystal display panel or plasma display panel. By a look at the displayed acceleration and deceleration condition of the footpath, the runner can recognize that the acceleration and deceleration is being detected and the control system is operating appropriately. Since it is possible to make sure that the exercise equipment is not working in discord with the runner's intention, the runner can prognosticate a runaway of the exercise equipment. By knowing the limit of the follow-up capacity of the exercise equipment, the runner can be temperate in acceleration during running and exercise safely and adequately.

Referring to another embodiment shown in FIG. 8, description will be made of the user-motion-response type exercise equipment for the user for running or walking.

Figure 8:
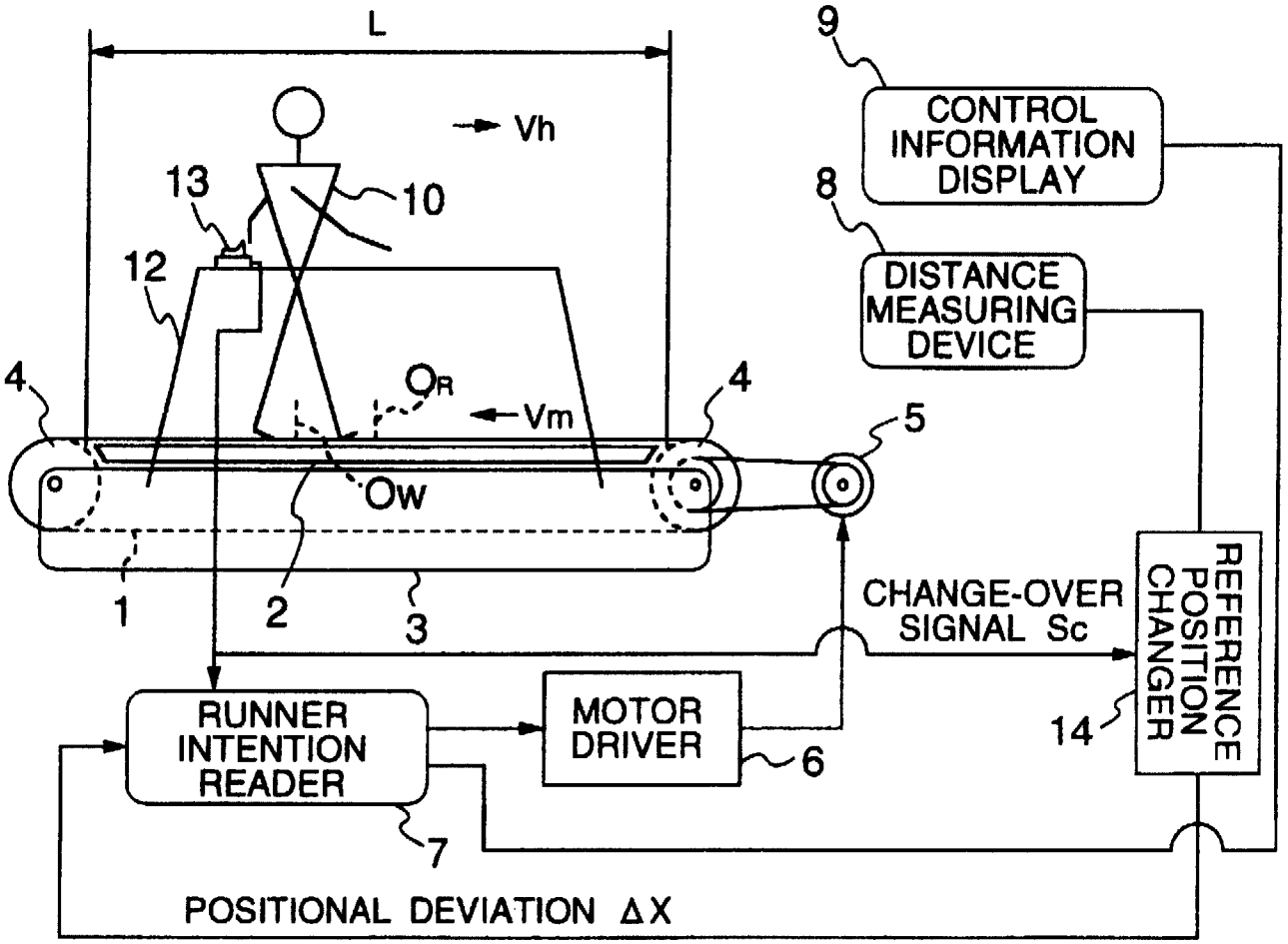
FIG. 8 is a construction diagram of the user-motion-response type exercise equipment according to another embodiment of the present invention.

This kind of exercise equipment has a use mode change-over switch installed on the handrail 12 as shown in FIG. 8. When the change-over switch 13 is manipulated, a change-over signal Sc is sent to the runner intention reader 7 and a reference position changer 14 located between the distance measuring device 8 and the runner intention reader 7. Those parts in FIG. 8 which are identical with or equal to those in FIG. 1 are designated by the same reference numerals.

When the user 10 sets the change-over switch 13 to the running mode, the reference position changer 14 regards the reference position on the moving belt surface as located at a point marked $O_R$ and calculates the positional deviation Δx on the basis of output of the distance measuring device 8. On the other hand, when the walking mode is set, the reference position changer 14 regards the reference position as located at point $O_w$ and calculates the positional deviation Δx from output of the distance measuring device 8.

Figure 9:
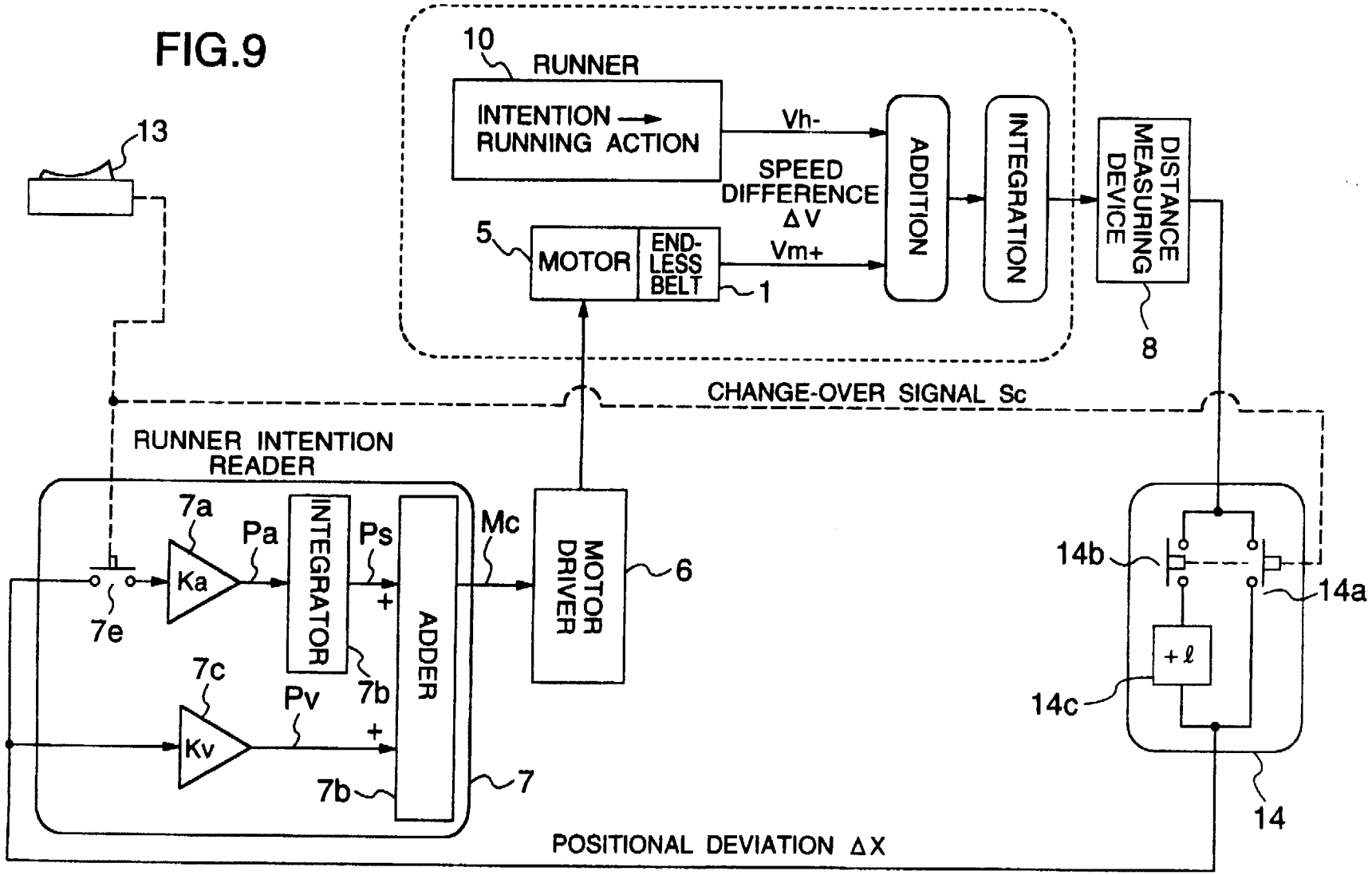
FIG. 9 is a block diagram showing detail of the control system of the user-motion-response type exercise equipment in FIG. 8.

As shown in FIG. 9, the reference position changer 14 includes switches 14*a*, 14*b* and a processor 14*c*. In the running mode specified by the change-over signal Sc from the change-over switch 13, the switch 14*a* is turns ON and the switch 14*b* is turned OFF. In the walking mode, the switch 14*a* is turned OFF and the switch 14*b* is turned ON. In the running mode that the switch 14*a* is ON (the switch 14*b* OFF), the positional deviation Δx of the user 10 from the reference position $O_R$ is sent as it is to the runner intention reader 7.

In the walking mode that the switch 14*b* is ON (the switch 14*a* OFF), the positional deviation Δx output from the reference position changer 14 is a sum of the deviation Δx of the user 10 from the reference position $O_R$ and a distance l between the reference positions $O_R$–Ow.

This means that the distance measuring device 8 measures a deviation of the user from the reference position $O_R$ and since in the walking mode the user 10 walks with the position Ow as the reference position, the positional deviation Δx sent to the runner intention reader 7 is calculated such that the reference position is Ow.

A switch 7*e* is attached to the integral control system of the runner intention reader 7. Like the switch 14*a* in the reference position changer 14, which in the running mode turns ON by a change-over signal Sc, the switch 7*e* turns ON in the running mode and turns OFF in the walking mode by the change-over signal Sc.

Therefore, the runner intention reader 7 has the integral control system and the proportional control system operating in the running mode but has only the proportional control action operating in the walking mode.

When the user 10 sets the change-over switch 13 to the running mode, the user intention reader in FIG. 8 becomes identical with the one in FIG. 1.

Description will then be made of the operation of the user-motion-response type exercise equipment when the user 10 sets the change-over switch 13 to the walking mode and walks for rehabilitation.

It is desirable that the runner intention reader 7 is provided with a limiter to stop the motor 5 the moment the user 10 comes behind the reference position Ow when the exercise equipment is put in the walking mode.

Figure 10A:
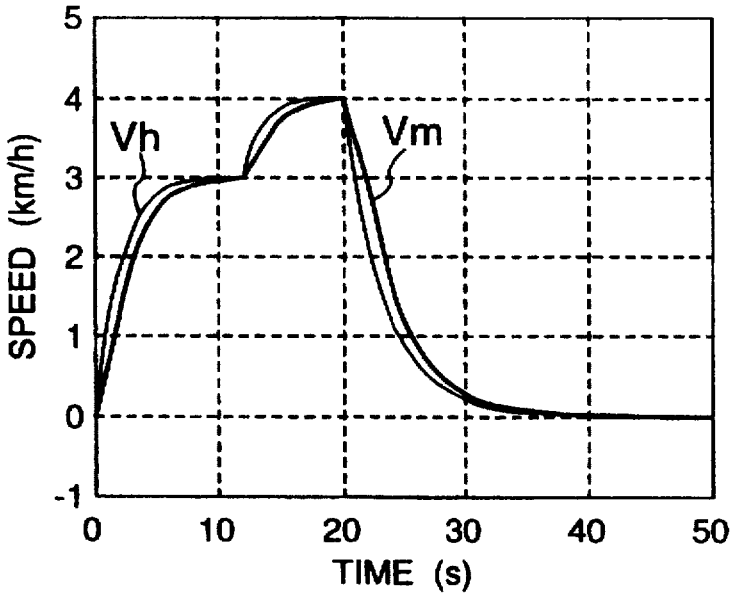
FIGS. 10A and 10B are diagrams showing the characteristics of the user-motion-response type exercise equipment by simulation of the user-motion-response type exercise equipment in FIG. 8.
Figure 10B:
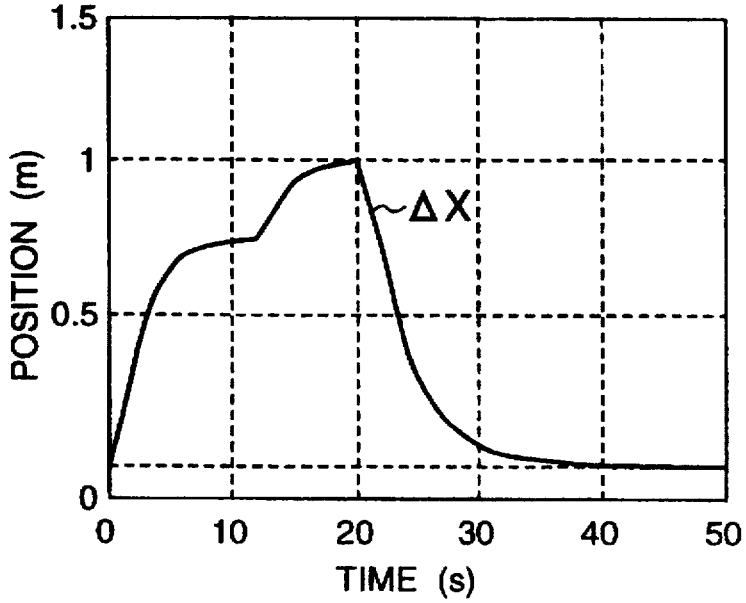

As shown in FIGS. 10A and 10B, a simulation was conducted about changes in the moving speed Vm of the moving surface of the endless belt 1, in which the user 10 walked at a speed expressed by Eq. (2) from when he crosses the reference position Ow (t=0) until under 12 seconds, the user 10 walked at a speed expressed by Eq. (3) from 12 seconds until under 20 seconds, and after 20 seconds the user 10 slowed down as expressed by Eq. (4)

$$Vh=Vh_1 \quad (2)$$

$$Vh=Vh_1+Vh_2 \quad (3)$$

$$Vh=Vh_1+Vh_2-Vh_3 \quad (4)$$

wherein $$Vh_1=(1-\exp(-0.5t))\times 0.833$$

$$Vh_2=(1-\exp(-0.6(t-12)))\times 0.278$$

$$Vh_3=(1-\exp(-0.3(t-20)))\times 1.111$$

and wherein t denotes elapsed time from the start of walking.

0.833, 0.278 and 1.111 are final speeds (m/s) of Eqs. (2) to (4) after passage of infinite time.

FIG. 10A shows changes in the walking speed Vh of the walker 10 and the moving speed Vm of the moving surface when gain Kv of the amplifier 7*c* in the runner intention reader 7 in FIG. 9 is Kv=1.2(1/s). Note that the moving speed Vm in FIG. 10A is in units of km/h. FIG. 10B shows the positional deviation Δx of the walker (user) 10 from the reference position Ow.

The walking speed increased from the reference position Ow, and when the walker advanced one meter from the reference position, the walking speed reached 4 km/h, then the walking speed Vh dropped quickly. Accordingly, the walker's position receded, both walking speed Vh and moving belt surface speed Vm fell to zero, and the walker's position returned to the reference position Ow. So long as the user 10 is stationary, the moving belt surface does not move, either.

As is clear from the foregoing, even if the user 10 decelerates quickly, he can stop without dropping off the rear portion of the moving belt surface.

Figure 11:
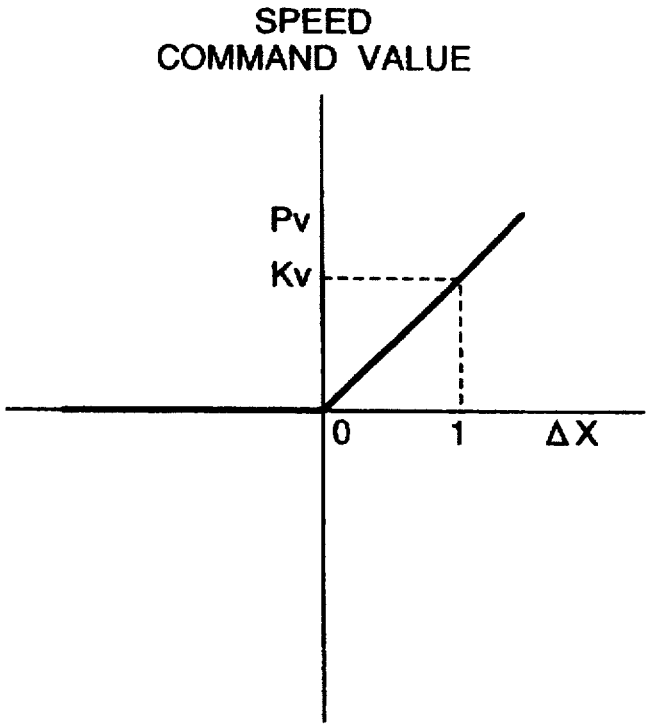
FIG. 11 is a diagram showing an example of the characteristics of the speed command processor of the runner intention reader in the user-motion-response type exercise equipment in FIG. 8.

FIG. 11 shows an example of speed command characteristics of the amplifier 7*c*. If the positional deviation Δx is negative, the speed command value Pv=0 is maintained. Thus, if the user recedes from the reference position Ow, the motor 5 is stopped. Therefore, the runner intention reader 7 works such that it contains a limiter. The speed command characteristics of the amplifier 7*c* shown in FIG. 11 apply to the amplifier 7*c* in the runner intention reader 7 in FIG. 2.

In order not to drop off the endless belt 1 in the walking mode, the user, that is, the walker can shift the reference position Ow backward. As a result, the footpath in front of the user becomes longer, so that the range in which the user can move forward becomes wider. The more the user moves forward away from the reference position, the faster the running speed of the runner becomes. Therefore, shifting the reference position Ow backward away from the user means that the variable speed range of the moving speed Vm of the endless belt becomes wider. The user-motion-response type exercise equipment in FIG. 9 is applicable to a wide range of walking from slow walking for rehabilitation to quick walking like in competitive walking.

In the embodiment shown in FIG. 8, when the change-over switch 13 is set to the walking mode, if the reference position 0 for the running mode is used instead of using the receded Ow as the reference position, the reference position changer 14 is disabled and the change-over signal Sc is sent only to the runner intention reader 7 so that output of the distance measuring device 8, that is, the positional deviation Δx can be sent directly to the runner intention reader 7. The user-motion-response type exercise equipment according to this modified embodiment offers the same effects as in the user-motion-response type exercise equipment in FIG. 8, only one difference being that this exercise equipment has the same variable speed range of the endless belt 1 as that in the exercise equipment in FIG. 1.

In the embodiment of FIG. 8, if the integral control system of the runner intention reader 7 is removed, the exercise equipment is dedicated to walking.

In the embodiments in FIGS. 1 and 8, the distance measuring device 8 is installed in front of the user, but it may be installed at the rear of the user. When the distance measuring device 8 is installed at the rear of the user, the distance measuring device 8 calculates and outputs the user's positional deviation Δx from the reference position as follows.

In the running mode in the embodiments of FIGS. 1 and 8, the distance measuring device 8 subtracts its installation distance with respect to the reference position 0 or $0_R$ from the measured distance between the user's position on the moving belt surface and the distance measuring device. In the walking mode in FIG. 8, even if the reference position Ow is moved closer to the distance measuring device, the distance measuring device performs above-mentioned calculations on the basis of the installation distance in the running mode. The reference position changer produces the positional deviation Δx by adding the distance l between the reference positions $O_R$–Ow to the output (the measured distance—the installation distance) of the distance measuring device. The user 10 swings his arms to make use of spring action and reaction. If the distance measuring device 8 measures the arms swung before the breast, there is a positional difference between the arms and the body, which results in measurement errors. Therefore, it is necessary to differentiate the swinging arms from the moving body in processing. Since the arms are not swung to the upper part of the shoulder, if the distance measuring device is installed at the rear of the user, there will be no measurement errors.

What is claimed is:

1. A user-motion-response type exercise equipment comprising:

an endless belt mechanism having a moving surface for the user to walk or run on;

driving means for driving said endless belt mechanism such that said moving surface moves at a speed in accordance with a control signal supplied from outside;

position detecting means for detecting the user's position on said moving surface; and control means for performing a control action combining a proportional control action and an integral control action in parallel in accordance with a positional deviation Δx from a reference position for the user on said moving surface of said endless belt mechanism to said user's position detected by said position detecting means as a controlled variable, generating said control signal on the basis of a result of said control action, and sending said control signal to said driving means.

2. A user-motion-response type exercise equipment according to claim 1, wherein after said control action has been done, if said control means receives a result that said moving surface is to be moved in a first direction, said control means sends said control signal to move said moving surface as specified by said result, and if said control means receives a result that said moving surface is to be moved in a direction opposite to said first direction, said control means sends said control signal to stop said moving surface.

3. A user-motion-response type exercise equipment according to claim 1, further comprising display means for receiving a signal corresponding to said control signal from said control means and displaying control information on the basis of the signal received.

4. A user-motion-response type exercise equipment according to claim 1, further comprising change-over means for changing over the use mode of the user between walking and running on said moving surface of said endless belt mechanism, wherein said control means is provided with a switch to, according to a select signal from said selector means, perform a control action only by a proportional control action in the walking mode and perform a control action combining a proportional control action and an integral control action in the running mode.

5. A user-motion-response type exercise equipment according to claim 4, further comprising reference position changer means for, upon recognizing from a change-over signal from said change-over means located between said position detecting means and said control means that the reference position has changed, calculating the positional deviation Δx according to the reference distances a detection result from said position detecting means before and after the change on the basis of a detection result of said position detecting means in the walking mode for the user from a detection result of said position detecting means when detecting the user's position with respect to the reference position in the running mode, and outputting the positional deviation Δx to said control means as a controlled variable.

6. A user-motion-response type exercise equipment according to claim 1, wherein said control signal, corresponding to said controlled variable in a proportional control action of said control means using a detection result from said position detecting means as said controlled variable, is held at zero when a value of said controlled variable is negative.

7. A user-motion-response type exercise equipment comprising:

an endless belt mechanism having a moving surface for a user to walk on;

driving means for driving said endless belt mechanism for moving said moving surface at a speed according to a control signal supplied from outside;

position detecting means for detecting the user's position on said moving surface; and control means for performing a control action including a proportional control action in accordance with a positional deviation Δx from a reference position for the user on said moving surface of said endless belt mechanism to said user's position detected by said position detecting means as the controlled variable, generating said control signal on the basis of a result of control action, and sending said control signal to said driving means.

8. A user-motion-response type exercise equipment according to claim 7, wherein said control signal, corresponding to said controlled variable in a proportional control action of said control means using a detection result from said position detecting means as said controlled variable, is held at zero when a value of said controlled variable is negative.

9. A user-motion-response type exercise equipment according to claim 1, wherein said position detecting means is installed at the rear of the user on said moving surface.

10. A user-motion-response type exercise equipment according to claim 7, wherein said position detecting means is installed at the rear of the user on said moving surface.

11. A user-motion-response type exercise apparatus comprising:

an endless belt mechanism having a moving surface for the user to walk and/or run on;

a driver driving said endless belt mechanism such that said moving surface moves at a speed in accordance with a control signal supplied from outside;

a position detector detecting the user's position on said moving surface; and a controller performing a control action combining a proportional control action and an integral control action in parallel in accordance with a distance form a reference position for the user on said moving surface of said endless belt mechanism to said user's position detected by said position detector as a controlled variable, generating said control signal on the basis of a result of said control action, and feeding said control signal to said driver.

12. A user-motion-response type exercise equipment comprising:

an endless belt mechanism having a moving surface for a user to walk on;

a belt-driver driving said moving surface of said endless belt mechanism at a speed according to a control signal;

a position detector continuously detecting a user's real-time position on said moving surface, and continuously outputting a position signal indicative of said user's real-time position; and a controller receiving said position signal concerning said user's real-time position from said position detector and determining a real-time positional deviation $\Delta x$ of said user from a reference position of said moving surface of said endless belt mechanism, and continually adjusting said control signal, and therefore said speed, proportionally to a degree of said real-time positional deviation $\Delta x$.

13. A user-motion-response type exercise equipment according to claim 12, wherein controller holds said control signal at a predetermined value which stops said moving surface of said endless belt mechanism during times when said real-time positional deviation $\Delta x$ is indicative of said user being downstream from said reference position on said moving surface of said endless belt mechanism.

14. A user-motion-response type exercise equipment according to claim 12, wherein said position detector is installed at one of in front of and behind said user on said moving surface.

* * * * *